United States Patent [19]

Kourogi et al.

[11] Patent Number: 4,802,814

[45] Date of Patent: Feb. 7, 1989

[54] DEVICE FOR ATTACHING FRONT LOADER TO TRACTOR

[75] Inventors: Isao Kourogi; Keiichi Masuda; Masami Hirooka; Yoshio Tomiyama; Kazunori Yoshiuchi; Takashi Gokenya, all of Osaka, Japan

[73] Assignee: Kubota Ltd., Osaka, Japan

[21] Appl. No.: 32,384

[22] Filed: Mar. 31, 1987

[30] Foreign Application Priority Data

Apr. 23, 1986 [JP] Japan ..... 61-93923
Apr. 23, 1986 [JP] Japan ..... 61-93924
Nov. 28, 1986 [JP] Japan ..... 61-285028

[51] Int. Cl.[4] ..... B66C 23/36
[52] U.S. Cl. ..... 414/686; 403/13
[58] Field of Search ..... 414/686, 685; 403/13, 403/14

[56] References Cited

U.S. PATENT DOCUMENTS 3,460,690 7/1969 Seifert ..... 414/686
3,949,889 4/1976 Moe ..... 414/686
4,280,783 7/1981 Hayward ..... 414/686
4,345,870 8/1982 Anderson et al. ..... 414/686
4,347,031 8/1982 Friesen ..... 414/686
4,470,751 9/1986 Masuzawa et al. ..... 414/686
4,548,543 10/1985 Lenertz et al. ..... 414/686
4,565,484 1/1986 Hamada et al. ..... 414/686
4,609,184 9/1986 Elkins, Sr. .

*Primary Examiner*—Robert J. Spar
*Assistant Examiner*—Donald W. Underwood
*Attorney, Agent, or Firm*—Birch, Stewart, Kolasch & Birch

[57] ABSTRACT

A device for attaching a front loader to a tractor by removably mounting each of a pair of boom supporting masts on a mast support fixed to the tractor body and removably fixing the front end of each brace extending forward from the mast to a brace fixing member secured to the front end of the tractor body. One of the lower end of each mast and the upper side of the mast support has a projection, and the other of these parts has a recessed portion for receiving the projection. The mast is pivotably supported by means of the projection and the recessed portion from below while being thereby restrained from moving longitudinally of the tractor body. A guide on the brace end and the fixing member coact to hold the brace end in position. The mast and the brace are fixed in position by a lockpin. The loader can be removably attached to the tractor with ease and high rigidity.

7 Claims, 6 Drawing Sheets

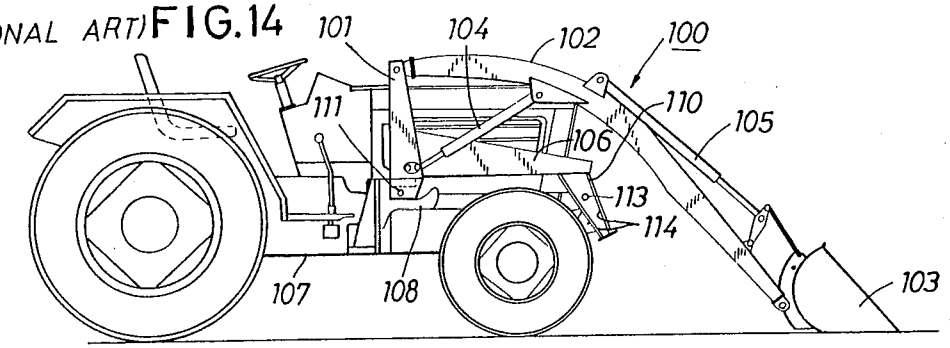
(COVENTIONAL ART) FIG.14
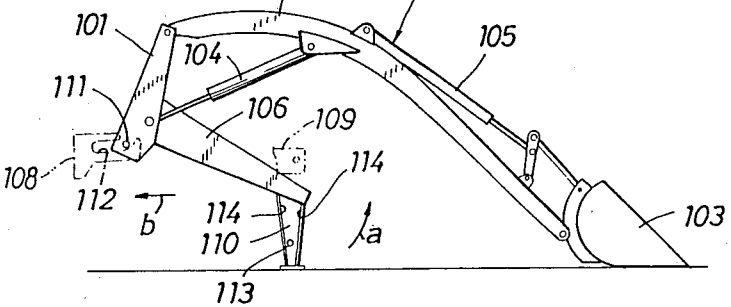
FIG.15 (COVENTIONAL ART)

DEVICE FOR ATTACHING FRONT LOADER TO TRACTOR

FIELD OF THE INVENTION AND RELATED ART STATEMENT

The present invention relates to a device for attaching a front loader to a tractor.

Various working implements are removably attached to the front of tractors for performing various kinds of work. Such working implements include, for example, a front loader equipped with a bucket or scraper at its front portion for transferring earth, sand or the like. It is desired that the front loader can be attached to and removed from the tractor with ease. For performing heavy work, the front loader must be so constructed as to be attached to the tractor with high rigidity and strength. Furthermore, the front loader needs to be so constructed that it can be stowed easily when removed.

FIGS. 14 and 15 show a known front loader attaching device fulfilling these requirements.

The front loader 100 shown comprises a pair of opposite masts 101, booms 102 pivoted to the upper ends of the masts 101 and extending forward, a bucket 103 pivoted to the front ends of the booms 102, a boom cylinder 104 provided between the mast 101 and the boom 102 for pivotally moving the boom 102 upward and downward, a bucket cylinder 105 provided between the bucket 103 and the boom 102 for pivotally moving the bucket 103 upward and downward, braces 106 fixed to the masts 101 and forwardly projecting therefrom, etc.

To attach the front loader 100 to the body of a tractor, 107, the tractor body 107 is provided with a mast support 108 at each side at a longitudinally intermediate portion thereof for removably mounting thereon the lower end of the mast 101, and a fixing portion 109 at a front portion of the body 107 for removably fixing the front end of the brace 106 with a pin.

To be easily stowable, the front loader 100 has a stand 110 at the front end of each brace 106. When the front loader 100 is to be stowed as removed from the tractor body 107, the bucket 103 and the stands 110 are placed on the ground as seen in FIG. 15, whereby the loader can be held upright in its assembled form with good stability.

Further the front loader 100 is made easy to attach and remove by an engaging pin 111 mounted on the lower end of the mast 101, an engaging groove 112 resembling a beak and formed in the mast support 108, a pin hole 113 formed in the stand 110 for holding the stand 110 to the fixing portion 109, and a guide 114 provided on the stand 110 for guiding the stand 110 to register the pin hole 113 with a pin hole in the fixing portion 109.

With reference to FIG. 15, the front loader 100 is mounted in place by placing the engaging pin 111 at the lower portion of each mast 101 on the mast support 108 at the inlet of the engaging groove 112, with the bucket 103 and the stand 110 on the ground, and then retracting the piston of the boom cylinder 104 to raise each stand 110 in the direction of arrow a. During the rise of the stand 110, the guide portion 114 is guided by the fixing portion 109 to register the pin hole 113 with the pin hole in the fixing portion 109, while the engaging pin 111 is slidingly moved along the groove 112 rearward in the direction of arrow b to the innermost position. A pin is then inserted through the pin hole 113 to hold the stand 110 to the fixing portion 109, whereby the front end of the brace 106 is fixed to the tractor body 107. The engaging pin 111 in the innermost portion of the engaging groove 112 prevents the mast 101 from moving upward or downward.

To attach the front loader to the tractor, the engaging pin 111 is thus slidingly moved into the beak-resembling groove 112 of the mast support 108 according to the prior art illustrated in FIGS. 14 and 15, so that the stand 110 must be provided with the guide portion 114 which is elongated for the sliding movement of the pin 111. Since the guide portion 114 is a large distance away from the engaging groove 112 longitudinally of the tractor, these portions must be accurately positioned relative to each other. The arrangement is therefore costly to make.

With the front loader mounted in position, the engaging pin 111 is merely positioned within the engaging groove 112, and the portion of the mast support 108 at the innermost portion of the groove 112 withstands the load acting rearward (in the direction of arrow b in FIG. 15) during work. However, since the pin 111 is movable forward in a direction opposite to the direction of arrow b, the pin inserted in the pin hole 113 solely withstands the load acting in this direction. Accordingly, the rigidity of this arrangement is not fully satisfactory.

The bucket 103 of the front loader 100 is repeatedly driven forward, raised, retracted or otherwise moved. This moves the pin 111 within the groove 112, resulting in marked wear and entailing the problem of backlashing.

Further the guide portion 114 of the stand 110 is not adapted to align the pin hole 113 with the corresponding hole in the fixing portion 109, so that these holes are difficult to register with each other. This makes the attaching procedure cumbersome, further repeatedly subjecting the brace 106 to tension and compression during work to cause the stand 110 to backlash greatly relative to the fixing portion 109 and cause early damage to the fixing pin.

U.S. Pat. No. 4,470,751 discloses another prior-art device for attaching a front loader to a vehicle body. With this device, the lower end of a mast is fitted in a tapered opening of a mast support and firmly fixed to the support by a cotter bolt or like fastening bolt.

With this prior-art device, an abnormal load acts directly on the mast support during the operation of the front loader. Accordingly, the load supporting structure has problems in respect of durability.

Further when the mast is fixed to the mast support by the fitting between the tapered parts and screw-thread fastening means including the bolt, the errors involved in making the parts are combined to make accurate fitting difficult and render the bolt difficult to insert or withdraw not infrequently.

SUMMARY OF THE INVENTION

An object of the present invention is to provide a device for removably attaching a front loader to a tractor body with ease without necessitating very high dimensional accuracy of the parts concerned.

Another object of the present invention is to provide a device of the type described for attaching to a tractor body a front loader as placed on the ground in its assembled form, by guiding each mast longitudinally of the tractor body and guiding the forward end of each brace transversely of the body with the mast side temporarily supported on the tractor body to position the mast and the brace end in position, and thereafter fixing the mast and the brace end to the tractor body, the device thus being adapted to mount the loader in place easily with high rigidity.

Another object of the present invention is to provide a device of the type described for attaching a front loader to a tractor body which device is so adapted that the load on the front loader is not only supported by each mast and the support therefor but is also absorbed by the elastic deformation of the brace extending from the mast so as to be supportable by the overall structure including the masts, braces, etc., i.e. dividedly by the front and rearward portions of the tractor body, the device thus reducing the likelihood that an objectionable force will act on the tractor body concentrically locally.

BRIEF DESCRIPTION OF THE DRAWINGS

The drawings show embodiments of the present invention and a conventional device.

FIG. 14 is an overall side elevation showing the conventional device; and

FIG. 15 is a view showing how the conventional device is used.

DESCRIPTION OF THE PREFERRED EMBODIMENTS

Embodiments of the present invention will be described below with reference to the drawings.

Figure 6:
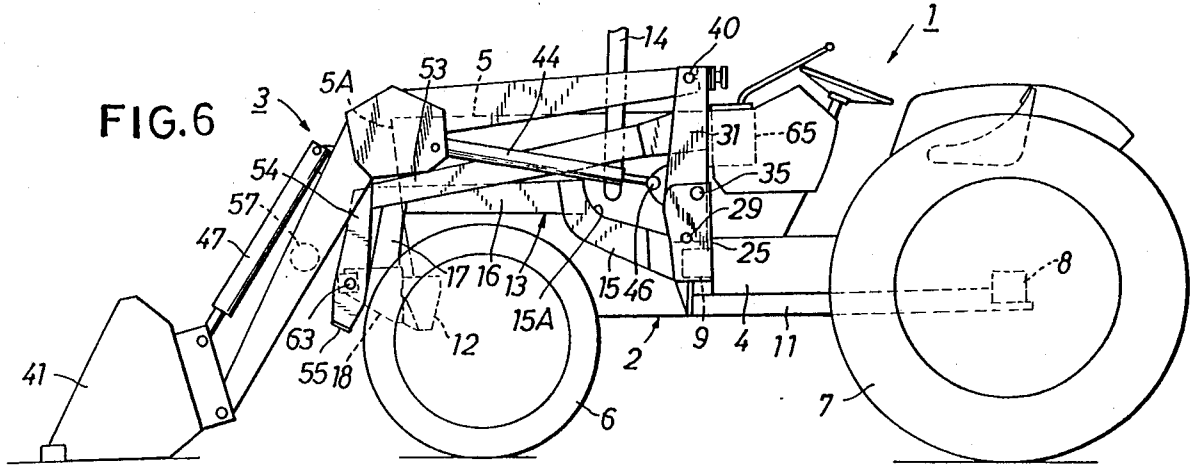
FIG. 6 is an overall side elevation showing a front loader as attached to the tractor body by the embodiment.
Figures 7, 8, 9:
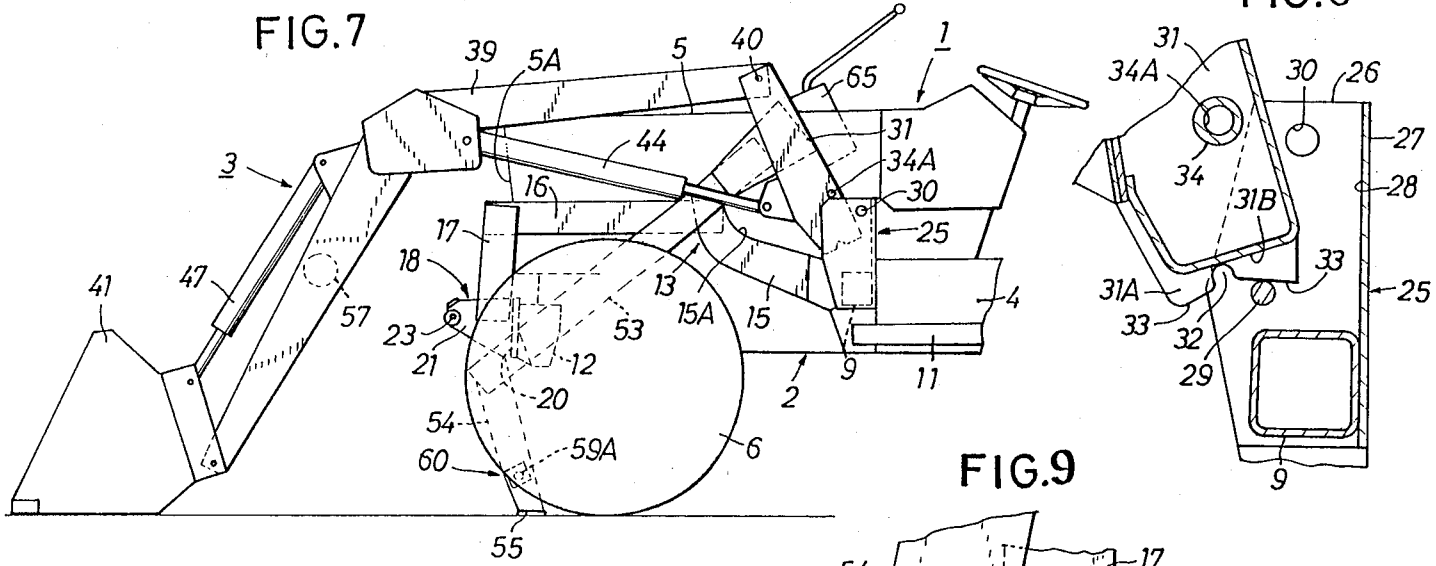
FIG. 7 is a fragmentary side elevation showing the same as removed from the tractor body.
FIG. 8 is a side elevation showing how the mast is mounted on the mast support.
FIG. 9 is a side elevation showing how the front end of the brace is attached to the front end of the tractor body.

FIGS. 6 and 7 show a two-axle four-wheel tractor 1 having a body 2 to which a front loader 3 is removably attached.

The tractor body 2 comprises a front axle frame, an engine, a transmission case 4, etc. which are rigidly joined together. The engine is covered with a bonnet 5. The tractor body 2 is supported by front wheels 6 and rear wheels 7. The rear wheels 7 are supported by a rear axle case 8 extending from opposite sides of the transmission case 4.

Figures 1, 2:
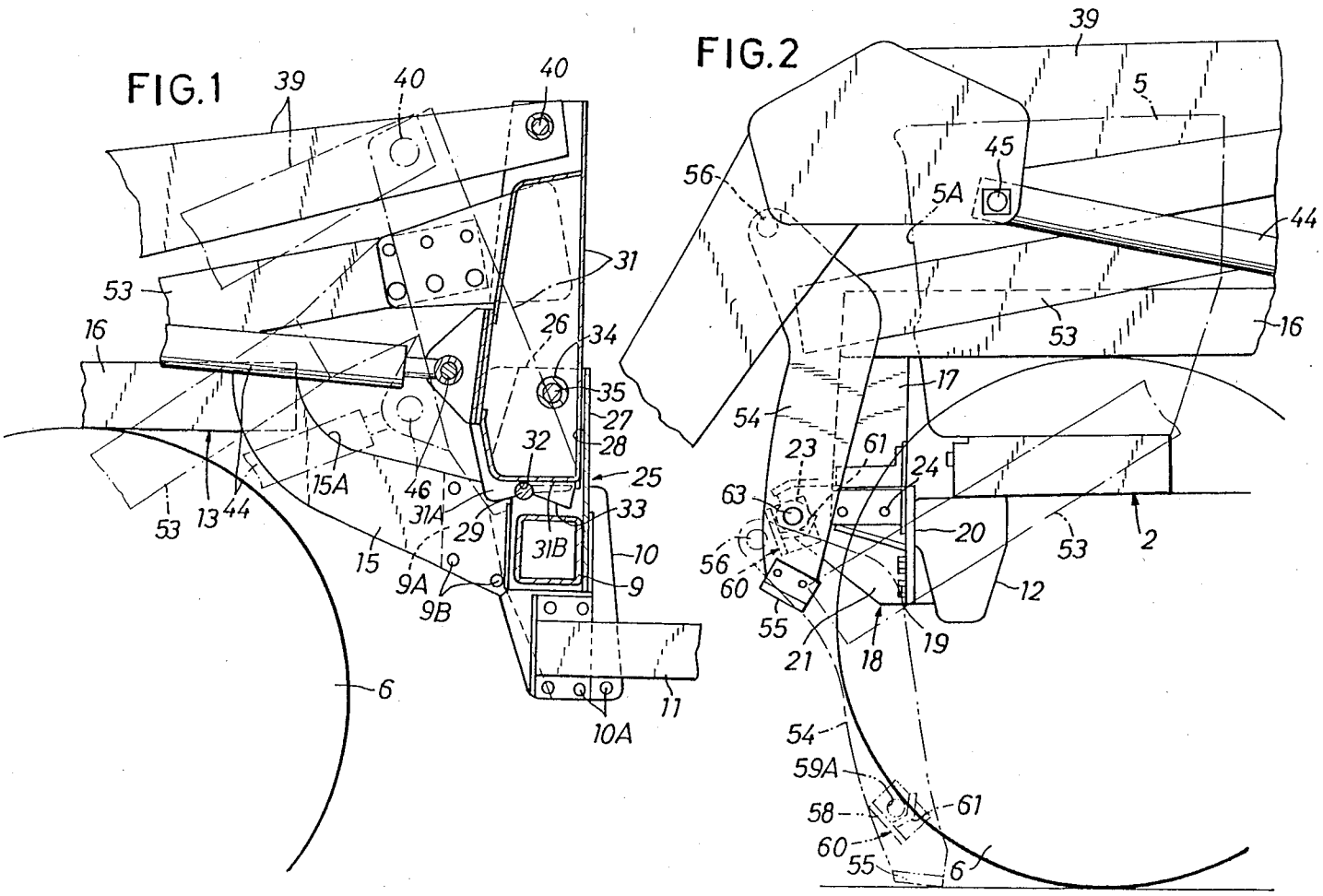
FIG. 1 is a side elevation partly in section and showing a mast and a mast support embodying the invention.
FIG. 2 is a side elevation showing a brace of the embodiment as attached to the front end of a tractor body.
Figure 3:
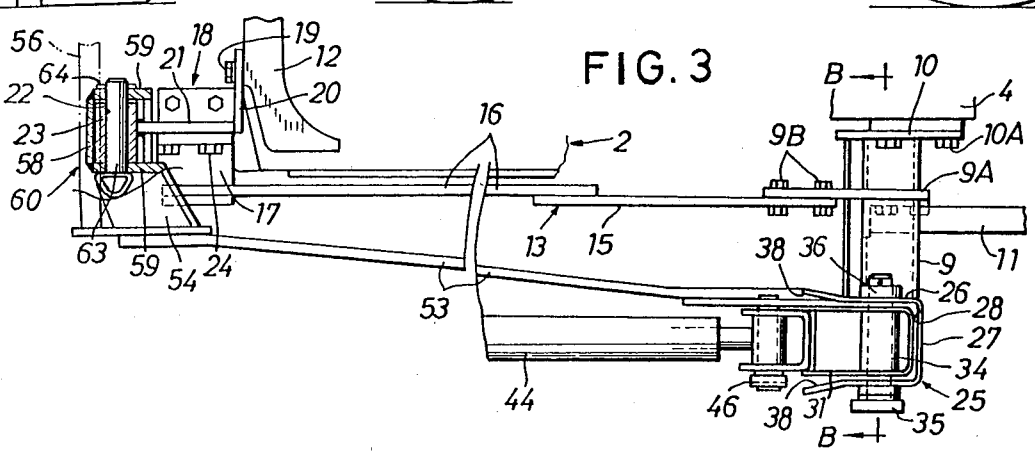
FIG. 3 is a fragmentary plan view showing the embodiment.

A longitudinally intermediate portion of the tractor body 2 has a base plate 10 fastened to each side thereof with bolts 10A for an outwardly extending bracket 9 (see FIGS. 1 and 3). The bracket 9 is fixedly connected to the rear axle case 8 by a rear connecting member 11. A bumper weight 12 secured to the front side of the front axle frame is fixedly connected to the bracket 9 by a front connecting member 13.

The front connecting member 13 comprises a first member 15 having a bent portion 15A for avoiding interference with a muffler 14 and fastened by bolts 9B to a plate 9A projecting forwardly upward from the bracket 9, a second member 16 welded to the front end of the first member 15 and extending therefrom horizontally forward above the front wheel 6 inwardly thereof, and a third member 17 welded to the front end of the second member 16 and extending downward therefrom. The first to third members 15 to 17 are each in the form of a plate with its widthwise direction oriented vertically.

The bumper weight 12, fixed to the front end of the tractor body 2, has a brace fixing member 18 fastened to the front side of the weight with bolts 19 at each end thereof. As seen in FIGS. 2, 3 and 9, the brace fixing member 18 comprises a base plate 20 and a vertical plate 21 secured thereto in an L-shaped arrangement when seen from above. As shown in the side elevation of FIG. 2, the vertical plate 21 is generally in the form of a forwardly projecting triangle and has at the upper portion of its projecting end a fixed tube 23 having a pin inserting bore 22 extending therethrough. The bore 22 has a horizontal axis extending transversely of the tractor body. The fixed tube 23 serves as a brace fixing portion.

The third member 17 included in the front connecting member 13 is fastened at its lower end to the vertical plate 21 of the fixing member 18 with bolts 24 as shown in FIGS. 2 and 9. Thus, at each side of the tractor body 2, the mast support bracket 9 is connected to the brace fixing member 18 by the front connecting member 13.

Figure 5:
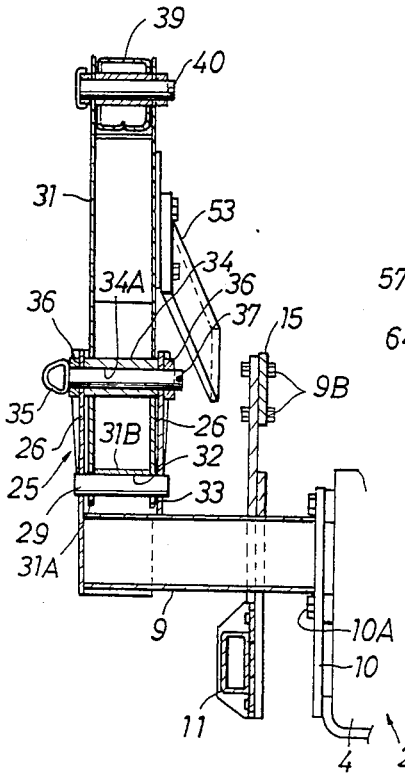
FIG. 5 is an elevation in section taken along the line B—B in FIG. 3.

As shown in FIGS. 1, 3 and 5, a mast support 25 extends upright from and is secured to the outer end of each of the opposite brackets 9.

The mast support 25 comprises a pair of opposite side walls 26 and a back wall 27, is in the form of an upright channel which is open at its front side and upper end and provides a mast fitting portion 28. Provided in the fitting portion 28 is a projection 29 having an axis extending transversely of the tractor body 2 and serving as a support point for pivotally moving the mast. The projection 29 is in the form of a pin of circular cross section extending between, and secured to, the side walls 26. As seen in FIG. 8, the projection 29 is positioned forwardly of the back wall 27 the greatest possible distance away therefrom. Above the projection 29, the opposite side walls 26 are formed with a lockpin hole 30, as shown in FIGS. 7 and 8, extending therethrough transversely of the tractor body.

The front loader 3 has a pair of opposite masts 31 removably fittable in an upright position into the fitting portions 28 of the pair of mast supports 25, respectively. Each mast 31 is in the form of a hollow box and is dimensioned to fit in the fitting portion 28 of the mast support 25. The mast 31 has at its lower end a pair of opposed skirts or flat members 31A, each of which is formed with a recessed portion 32 fittable to the projection 29. The lower edge of the skirt 31A has guide faces 33 immediately adjacent to the recessed portion 32 in front and rear thereof. With the recessed portion 32 fitting to the projection 29, the lower end face 31B of the mast bears on the projection 29. The guide faces 33 are so shaped that when the mast 31 is fitted into the fitting portion 28 of the mast support 25 from above, the guide face 33 comes into contact with the projection 29 and guides the mast lower end to fit the recessed portion 32 to the projection 29. Thus, the guide faces 33 slant upward toward the recessed portion 32. The projection 29 and the recessed portion 32 constitute means for pivotably supporting the mast 31 from below while restraining the mast 31 from moving longitudinally of the tractor body 2.

Alternatively, the recessed portion 32 may be formed in the mast support 25 with the projection 29 provided on the lower end of the mast 31 in a relation opposite to the illustrated relation.

The mast 31 is further fixedly provided with a tube 34 having a pin bore 34A which is aligned with the lockpin holes 30 of the mast support 25 when the mast 31 is placed upright into the fitting portion 28 with the recessed portions 32 brought into fitting engagement with the projection 29. A lockpin 35 is laterally inserted from outside through the aligned pin holes 30 and 34A. The pin 35 and the pin holes 30, 34A provide means for removably attaching the mast 31 to the mast support 25.

FIGS. 3 and 5 further show a pair of opposite collars 36 and a retaining pin 37. FIG. 3 also shows mast guide portions 38 extending from the front ends of the side walls 26 of the support 25 outward away from each other.

A pair of forwardly projecting booms 39 are pivoted by pins 40 to the upper ends of the pair of masts 31, respectively. Working means 41, such as a bucket or scraper, is pivoted to the forward ends of the booms 39. The boom 39 and the mast 31 are interconnected by drive means 44 for pivotally moving the boom 39 about the pin 40, i.e. about an axis extending transversely of the tractor body. The drive means 44 comprises a hydraulic cylinder which is connected to an intermediate portion of the boom 39 by a pin 45 and to an intermediate portion of the mast 31 by a pin 46.

A hydraulic cylinder 47 is provided between the working means 41 and the boom 39 for moving the working means 41. The advance or retraction of the piston of the cylinder 47 moves the working means 41 about a transverse axis.

Figures 10, 11, 12, 13:
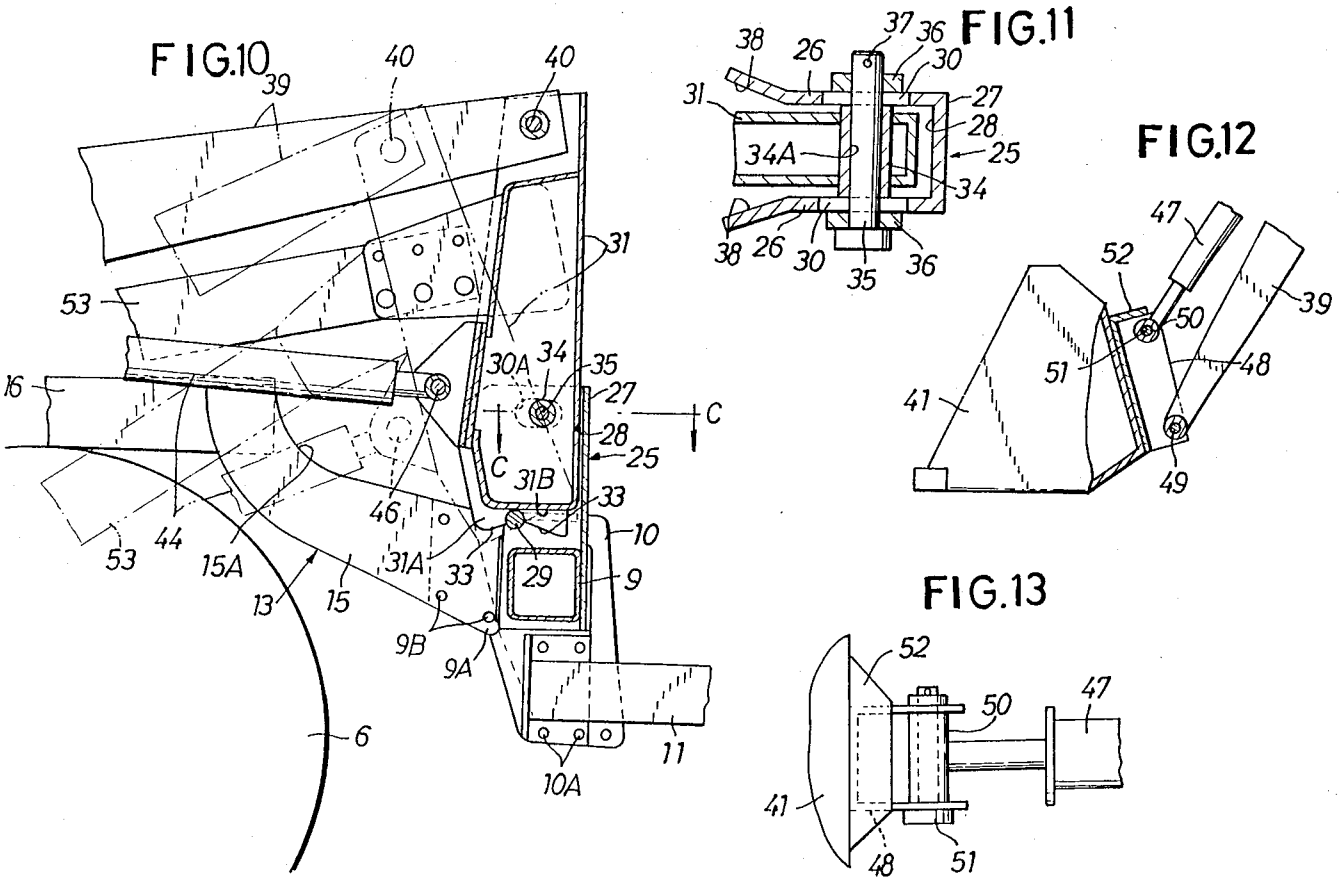
FIG. 10 is a side elevation corresponding to FIG. 1 and showing another embodiment of the invention.
FIG. 11 is a view in section taken along the line C—C in FIG. 10.
FIG. 12 is a side elevation partly in section and showing a working device as attached to a boom assembly.
FIG. 13 is a fragmentary plan view showing the same.

Stated more specifically with reference to FIGS. 12 and 13, a channel-shaped bracket 48 is secured to the back of the working means 41. The forward end of the boom 39 is pivoted to the bracket 48 by a pin 49. The piston rod end 50 of the hydraulic cylinder 47 is pivoted to the bracket 48 by a pin 51. A flat trapezoidal cover plate 52 is attached to the top of the bracket 48 for preventing earth, sand or the like from lodging in the pivot portions including pins 49 and 51.

A pair of forwardly projecting braces 53 are respectively fixed to the pair of masts 31 at a vertically intermediate portion thereof and are positioned laterally outward of the front connecting members 13. Each of the braces 53 is a plate which is positioned with its widthwise direction oriented vertically. The brace 53 has a downwardly extending stand member 54. A ground contact plate 55 which is to be placed on the ground interconnects the lower ends of the opposed stand members 54. A connector bar 56 interconnects the upper ends of the pair of stand members 54. When the front loader is mounted in place, the opposed braces 53 are interconnected by the connector bar 56 in front of the front grille 5A of the bonnet 5 (see FIGS. 3 and 4).

Figure 4:
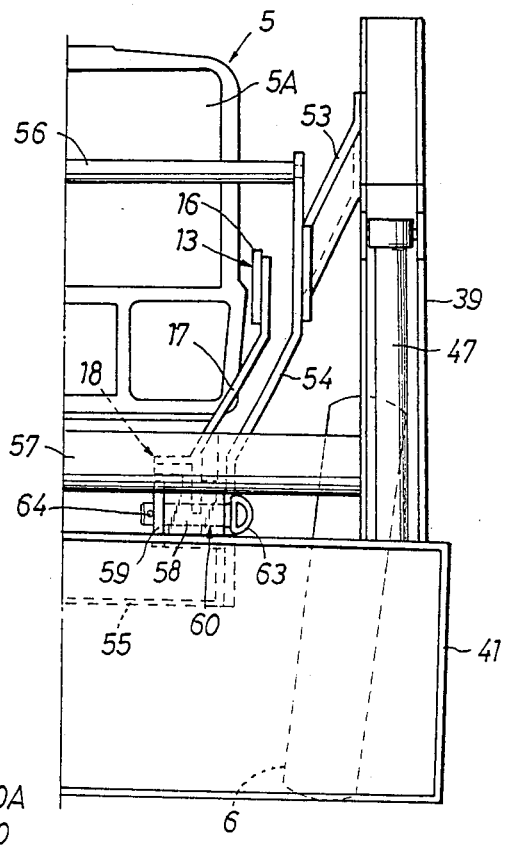
FIG. 4 is a front view showing the portion indicated by an arrow A in FIG. 3.

Further FIGS. 4 and 6 show a connector bar 57 interconnecting the pair of booms 39.

With reference to FIGS. 3 and 9, each of the stand members 54 is fixedly provided on its inner side with a channel-shaped guide member 60 comprising a front wall 58 and a pair of opposed side walls 59 and positioned close to its lower end. Each of the side walls 59 has a pin hole 59A with a lateral axis. Below the pin holes 59A, a positioning plate 61, generally V-shaped when seen from one side, is secured to the front wall 58 and the side walls 59. The plate 61 is formed with a slit 62.

The guide member 60 is adapted to fittingly receive in the space between its side walls 59 the fixed tube 23 of the fixing member 18 which tube extends transversely of the tractor body 2, whereby the stand member 54 is guided properly with respect to the widthwise direction of the tractor body 2. Further when the guide member 60 and the fixing member 18 are moved relative to each other to fit the vertical plate 21 of the member 18 into the slit 62 in the positioning plate 61 of the member 60 and to bring the upper side of the positioning plate 61 into contact with the fixed tube 23 from below, the pin bore 22 of the fixed tube 23 is registered with the pin holes 59A of the side walls 59. A lockpin 63 is then laterally inserted from outside through the registered bore 22 and holes 59A, whereby the front end of the platelike brace 54 extending forward from each mast 31 is fixed to the front end of the tractor body 2. The lockpin 63, which is removable, is prevented from slipping off by a retaining pin 64 inserted through the inner end of the pin 63 (see FIGS. 3 and 4).

FIGS. 10 and 11 show another means for attaching the mast 31 to the mast support 25. Each side wall 26 of the mast support 25 is formed with a lockpin hole 30A which is elongated longitudinally of the tractor body 2. When the lockpin 35 is inserted through the tube 34 and the holes 30A and held in place by the retaining pin 37, with the mast 31 mounted on the mast support 25, the lockpin 35 is slidable within the range of the pin hole 30A longitudinally of the tractor body 2. Thus, the lockpin hole 30A serves as a portion for permitting the mast 31 to move forward or rearward about the pivotably supporting means 29, 32.

The attaching means of FIGS. 10 and 11 includes a pair of opposite collars 36 which are diametrically larger than the width of the pin hole 30A. Each collar 36 as fitted to the outer surface of the side wall 26 is slidable forward or rearward with the pin 35 within the range of the pin hole 30A.

The pin hole 30A may be in the form of a circular arc centered about the support means 29, 32. Throughout FIGS. 1, 10 and 11, like parts are designated by like reference numerals.

FIG. 7 shows a control box 65 which is mounted on the upper end of the right mast of the front loader 3.

The front loader 3 is attached to the tractor 1 by the device of the foregoing structure in the following manner.

FIG. 8 and phantom lines in FIGS. 1, 2 and 10 show the front loader 3 as removed from the tractor body 2 and held in an upright position by the working means 41 and the stand members 54. To attach the front loader 3 in this state to the tractor body 2, the tractor 1 is advanced to position the lower end of each mast 31 above the fitting portion 28 of the mast support 25. The control box 65 is then connected to the hydraulic piping on the tractor body, and the piston of each drive means 44, i.e. hydraulic cylinder, is retracted. This lowers the mast 31 with its lower end in contact with the back wall 27 of the mast support 25, further causing the guide faces 33 to slide in contact with the projection 29 to fit the recessed portions 32 at the lower end of the mast 31 to the projection 29.

Further retraction of the piston of the hydraulic cylinder 44 moves the mast 31 about the projection 29, moving the brace 53 upward to fit the guide member 60 to the fixed tube 23 of the fixing member 18 and bring the positioning plate 61 of the member 60 into contact with the tube 23 from below, whereby the upward movement of the brace 53 is prevented with the pin bore 22 of the fixing member 18 in register with the pin holes 59A of the stand member 54. The lockpin 63 is then inserted through the bore 22 and the holes 59A to fix the brace 53 to the tractor body 2. The mast 31 is now positioned upright on the mast support 25, and the lockpin holes 30 are in register with the bore 34A of the tube 34 on the mast 31. The lockpin 35 is inserted through the holes 30 and the bore 34A to fix the mast 31 to the mast support 25.

With the embodiment of FIGS. 10 and 11, the means for attaching the mast 31 to the mast support 25 has longitudinally elongated pin holes 30A for permitting the mast 31 to move forward or rearward, so that the mast can be positioned in the support easily in attaching the front loader 3 to the tractor body 2, with some dimensional errors accommodated by the movement permitting portion.

Because the lower end of each mast 31 is supported from below by the pivotably supporting means on the mast support 25 and further because the attaching means has the movement permitting portion, the load acting on the loader 3 during operation can be absorbed by this portion. Since each brace secured to the mast 31 and extending forward therefrom is fixed to the front end of the tractor body 2, the load on the loader 3 is supported by the overall assembly including the masts 31, braces 53, etc. and is consequently supported dividedly by the front portion of the tractor body 2 and by another portion longitudinally away therefrom. This diminishes the likelihood that an objectionable force will act on the tractor body 2 concentrically locally.

The front loader 3 is removed from the tractor body 2 by the following procedure.

The working means 41 at the front ends of the booms 39 is placed on the ground by operating the boom drive means 44.

Each lockpin 63 is removed from the joint between the front end of the brace 53 and the fixing member 18, and each lockpin 35 is also removed.

By operating the boom drive means 44, the front ends of the braces 53 are lowered to place the stand members 54 on the ground, with the masts 31 moved about and supported by the pivotably supporting means.

The pistons of the drive means 44 are further advanced to raise the masts 31 to disengage the recessed portions 32 from the projections 29. The tractor 1 is thereafter moved rearward.

The front loader 3 thus removed from the tractor 1 is held upright in its assembled state.

What is claimed is:

1. A device for attaching to a tractor body a front loader having a pair of opposite booms carrying working means at their front ends, a pair of opposite masts pivotably supporting the pair of booms respectively, and a pair of opposite braces projecting forward from the pair of masts respectively, by removably mounting each of the masts on a mast support fixed to the tractor body and removably fixing the front end of each of the braces to a brace fixing member secured to a front portion of the tractor body, the device being characterized in that one of the lower end of each mast and the upper side of the mast support is provided with a projection serving as a support point for pivotally moving the mast for the attachment of removal of the front loader, the other of said parts having a recessed portion for receiving the projection, the projection and the recessed portion constituting means for pivotably supporting the mast from below while restraining the mast from moving longitudinally of the tractor body, the recessed portion being provided with a guide face for guiding the projection relative to the recessed portion, the device further including attaching means for connecting the mast support to the mast as supported by the pivotably supporting means from below.

the mast support is secured to the outer end of a bracket fixed to the side wall of the tractor body and projecting therefrom horizontally laterally outward, and a platelike connecting member extends longitudinally of the tractor body and is fixed to the bracket between the mast support and the tractor body side wall, the connecting member having a forward end secured to the brace fixing member and a longitudinally intermediate portion extending without interfering with a muffler on the tractor body.

2. A device for attaching to a tractor body a front loader having a pair of opposite booms carrying working means at their front ends, a pair of opposite masts pivotably supporting the pair of booms respectively, and a pair of opposite braces projecting forward from the pair of masts respectively, by removably fixing each of the masts to a mast support fixed to the tractor body and removably fixing the front end of each of the braces to a brace fixing member secured to a front portion of the tractor body, the device being characterized in that the fixing member is provided on each side of the front end of the tractor body and has a fixed tube having a bore extending therethrough transversely of the tractor body, each of the braces having at its front end a guide member guidable by the fixed tube and comprising a front wall and a pair of opposite side walls, the side walls of the guide member being formed with a lockpin hole positionable in register with the bore of the fixed tube, the guide member having a positioning member for registering the lockpin hole with the bore when brought into contact with the fixed tube from below, the guide member being provided with a lockpin removably insertable through the lockpin hole and the bore in register with each other.

3. A device as defined in claim 2 wherein each of the braces has a stand member at its front end, and when the brace is attached to the fixing member, the stand member is positioned in front of the front grille of the tractor body, the opposite stand members being interconnected by a connector at a position in front of the front grille, the opposite stand members further being interconnected by a ground contact plate attached to the lower ends of the stand members.

4. A device as defined in claim 2 wherein a front bumper is fixed to the front end of the tractor body, and the brace fixing member is fixed to each end of the front bumper as projected from the front side thereof.

5. A device for attaching to a tractor body a front loader having a pair of opposite booms carrying working means at their front ends, a pair of opposite masts pivotably supporting the pair of booms respectively, and a pair of opposite braces projecting forward from the pair of masts respectively, by removably mounting each of the masts on a mast support fixed to the tractor body and removably fixing the front end of each of the braces to a brace fixing member secured to a front portion of the tractor body, the device being characterized in that one of the lower end of each mast and the upper side of the mast support is provided with a projection serving as a support point for pivotally moving the mast for the attachment or removal of the front loader, the other of said parts having a recessed portion for receiving the projection, the projection and the recessed portion constituting means for pivotably supporting the mast from below while restraining the mast from moving longitudinally of the tractor body, the recessed portion being provided with a guide face for guiding the projection relative to the recessed portion, the device further including attaching means for connecting the mast support to the mast as supported by the supporting means from below, the fixing member being provided on each side of the front end of the tractor body and having a fixed tube with a bore extending therethrough transversely of the tractor body, each of the braces having at its front end a guide member guidable by the fixed tube and comprising a front wall and a pair of opposite side walls, the side walls of the guide member being formed with a lockpin hole positionable in register with the bore of the fixed tube, the guide member having a positioning member for registering the lockpin hole with the bore when brought into contact with the fixed tube from below, the guide member being provided with a lockpin removably insertable through the lockpin hole and the bore in register with each other.

6. A device for attaching to a tractor body a front loader having a pair of opposite booms carrying working means at their front ends, a pair of opposite masts pivotably supporting the pair of booms respectively, and a pair of opposite braces projecting forward from the pair of masts respectively, by removably mounting each of the masts on a mast support fixed to the tractor body and removably fixing the front end of each of the braces to a brace fixing member secured to a front portion of the tractor body, the device being characterized in that one of the lower end of each mast and the upper side of the mast support is provided with a projection serving as a support point for pivotally moving the mast for the attachment or removal of the front loader, the other of said parts having a recessed portion for receiving the projection, the projection and the recessed portion constituting means for pivotably supporting the mast from below while restraining the mast from moving longitudinally of the tractor body, the recessed portion being provided with a guide face for guiding the projection relative to the recessed portion, the device further including attaching means for connecting the mast support to the mast as supported by the pivotably supporting means from below, the attaching means having a portion for permitting the mast and the mast support to move forward or rearward relative to each other, the fixing member being provided on each side of the front end of the tractor body and having a fixed tube with a bore extending therethrough transversely of the tractor body, each of the braces having at its front end a guide member guidable by the fixed tube and comprising a front wall and a pair of opposite side walls, the side walls of the guide member being formed with a lockpin hole positionable in register with the bore of the fixed tube, the guide member having a positioning member for registering the lockpin hole with the bore when brought into contact with the fixed tube from below, the guide member being provided with a lockpin removably insertable through the lockpin hole and the bore in register with each other.

7. A device for attaching to a tractor body a front loader having a pair of opposite booms carrying working means at their front ends, a pair of opposite masts pivotably supporting the pair of booms respectively, and a pair of opposite braces projecting forward from the pair of masts respectively, by removably mounting each of the masts on a mast support fixed to the tractor body and removably fixing the front end of each of the braces to a brace fixing member secured to a front portion of the tractor body;

the device being characterized in that each of the opposite mast supports comprises a fitting portion, said fitting portion having a back wall and opposite side walls to form an open concave shape in plan view to receive the mast which will enter from a forward and higher position for removable insertion;

that a projection is provided to connect said opposite side walls at a point intermediate in height of each of the mast supports to serve as a pivot in an attaching or in a removing action;

that each of the masts is secured removably in a respective mast-fitting portion, each of the masts having a hollow box shape and its transverse dimension being sized to allow the mast to engage into the mast support, opposed skirts are formed on a lower end of each said mast, a recess is formed in each said skirt to receive said projection, an inclined slant guide face is formed on both sides of each recess to guide said projection into the recess, thus pivotal support means is formed by engagement of the projection with the recess;

that means is provided for removably attaching the mast to the mast support while the mast is supported by said projection comprising lockpin holes, oppositely opened on the opposite side walls of said mast support located above said projection and pins which are removably insertable transversely from the outside of the mast support and wherein each hole is formed to allow a longitudinal movement of the pin relative to the hole therein to buffer impacts which remain after the buffering action of the braces, and each hole extends longitudinally and is closed to control displacements of the engaged pin;

whereby breaking of the pins is avoided when elastic deformation of the braces take place due to external impacts.

* * * * *